US006315281B1

(12) United States Patent
Ehara

(10) Patent No.: US 6,315,281 B1
(45) Date of Patent: Nov. 13, 2001

(54) APPARATUS FOR SENDING OUT BILL OR CARD TYPE MATERIAL

(75) Inventor: Takashi Ehara, Iwatsuki (JP)

(73) Assignee: Asahi Seiko Co., Ltd. (JP)

( * ) Notice: Subject to any disclaimer, the term of this patent is extended or adjusted under 35 U.S.C. 154(b) by 0 days.

(21) Appl. No.: 09/746,237

(22) Filed: Dec. 22, 2000

Related U.S. Application Data

(63) Continuation of application No. 09/317,356, filed on May 24, 1999, which is a continuation of application No. 08/868, 266, filed on Jun. 3, 1997, now abandoned.

(30) Foreign Application Priority Data

Jun. 13, 1996 (JP) ..... 8-188006

(51) Int. Cl.[7] ..... B65H 3/06
(52) U.S. Cl. ..... 271/11; 271/112
(58) Field of Search ..... 271/11, 112, 161, 271/94, 162

(56) References Cited

U.S. PATENT DOCUMENTS 3,391,926 * 7/1968 Jaatinen ..... 271/112
3,964,740 * 6/1976 Lamb ..... 271/112
4,236,707 * 12/1980 Fujimoto ..... 271/112
4,310,151 * 1/1982 Fujimoto ..... 271/11
5,052,675 * 10/1991 Shehata et al. ..... 271/94

FOREIGN PATENT DOCUMENTS

2245834 * 12/1973 (DE) .
24 37 082 A 2/1976 (DE) .
39-6310 5/1939 (JP) .
0145945 * 2/1979 (JP) .
0040179 * 3/1979 (JP) .
0018578 * 11/1980 (JP) .
6-96349 4/1994 (JP) .
7-237764 9/1995 (JP) .

OTHER PUBLICATIONS

Patent Abstracts of Japan Sep. 12, 1995 Japan.

* cited by examiner

*Primary Examiner*—Christopher P. Ellis
*Assistant Examiner*—Patrick Mackey
(74) *Attorney, Agent, or Firm*—McGlew and Tuttle, P.C.

(57) ABSTRACT

This invention involves an apparatus which is able to payout surly and speedily sheet bodies one by one, while minimizing the overall dimensions of the apparatus and with a simplified structure. This present invention is an apparatus for paying out a sheet body which comprises at least a suction device which has an opening to absorb a sheet body, and a sending out device to send out the sheet body which is absorbed on this suction device, resisting to the absorption.

12 Claims, 6 Drawing Sheets

APPARATUS FOR SENDING OUT BILL OR CARD TYPE MATERIAL

CROSS-REFERENCE TO RELATED APPLICATIONS

This is a continuation of application Ser. No. 09/317,356 filed May 24, 1999, which in turn is a continuation of application Ser. No. 08/868,266 filed Jun. 3, 1997 now abandoned, the entire disclosure of each prior application is considered to be part of the disclosure of the accompanying application and is hereby incorporated by reference therein

FIELD OF THE INVENTION

The present invention pertains to an apparatus for paying out a sheet body which consists of paper or synthetic resin and the like. This invention is especially concerned with a sheet body payout apparatus for paying with certainty a bill as the sheet body which is paper money.

This invention is concretely concerned with an apparatus for paying out a sheet body which is suitable for fields in which bills are used, such as vending machines which contains ticket sale machines and the like, money change machines, money changing machines which are used for the resists industry and the like. Further, the sheet body with which this invention is concerned is typically bills which are folded freely. However the invention is also concerned with sheet bodies including card bodies such as telephone cards and commutation ticket cards which are bent freely.

BACKGROUND OF THE INVENTION

Apparatuses are known for paying out a bill such as a conventional sheet body payout apparatus including an apparatus for feeding a paper leaf. This is disclosed in the specification of Japanese Patent Disclosure 7-237764.

This feeder relates to an apparatus to supply paper leaves such as the bills which are stored in a hopper in a desired place wherein the various paper leaves are separated. In front of a hopper bottom wall on which bills are piled, a guidance plate of the bill is provided in the setting up condition and, on a single roller rotating axis, a separation roller and a carrying-out roller of the bill are provided respectively. This provides a complicated mechanism for the apparatus as disclosed in this specification.

A card sending-out apparatus for a card vending machine is also known as disclosed in the specification of Japanese Patent Application 4-283398 (or Japanese Disclosure Application 6-96349). As for this card sending-out apparatus, within the upper portion of two outside plates that are separated in parallel, cards forming a layered body are held. A complicated mechanism is provided with this apparatus for sending out a card with the paying-out roller and the sending-out roller of the card.

SUMMARY AND OBJECTS OF THE INVENTION

It is an object of the invention to provide a sheet body payout apparatus with a small and simple structure which doesn't need a complicated payout mechanism for the apparatus as is mentioned above.

It is a further object of the invention to provide an apparatus which is able to payout surly and speedily the sheet body one by one, while reducing the size of the apparatus (compared to known devices) and to simplify the structure.

According to the invention, an apparatus for paying out a sheet body is provided comprising at least suction means which has an opening to absorb or take up a sheet body, and sending out means for sending out the sheet body which is absorbed on the suction means, resisting the absorption.

The present invention also provides a payout apparatus of which the sending out means is within the opening of the suction means. Further, the present invention provides a payout apparatus with which drawer means is provided to put in and to draw out the sheet body which was sent out by the sending out means.

According to a preferred embodiment of the invention the payout device has a suction means which includes a fan apparatus.

Also, according to an embodiment of the present invention, the payout apparatus is provided in which the sending out means is a small tire-like wheel. According to the present invention the payout apparatus includes a drawer means including a plurality of rollers.

This invention is explained below, referring to attached drawings of the embodiment according to the invention.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
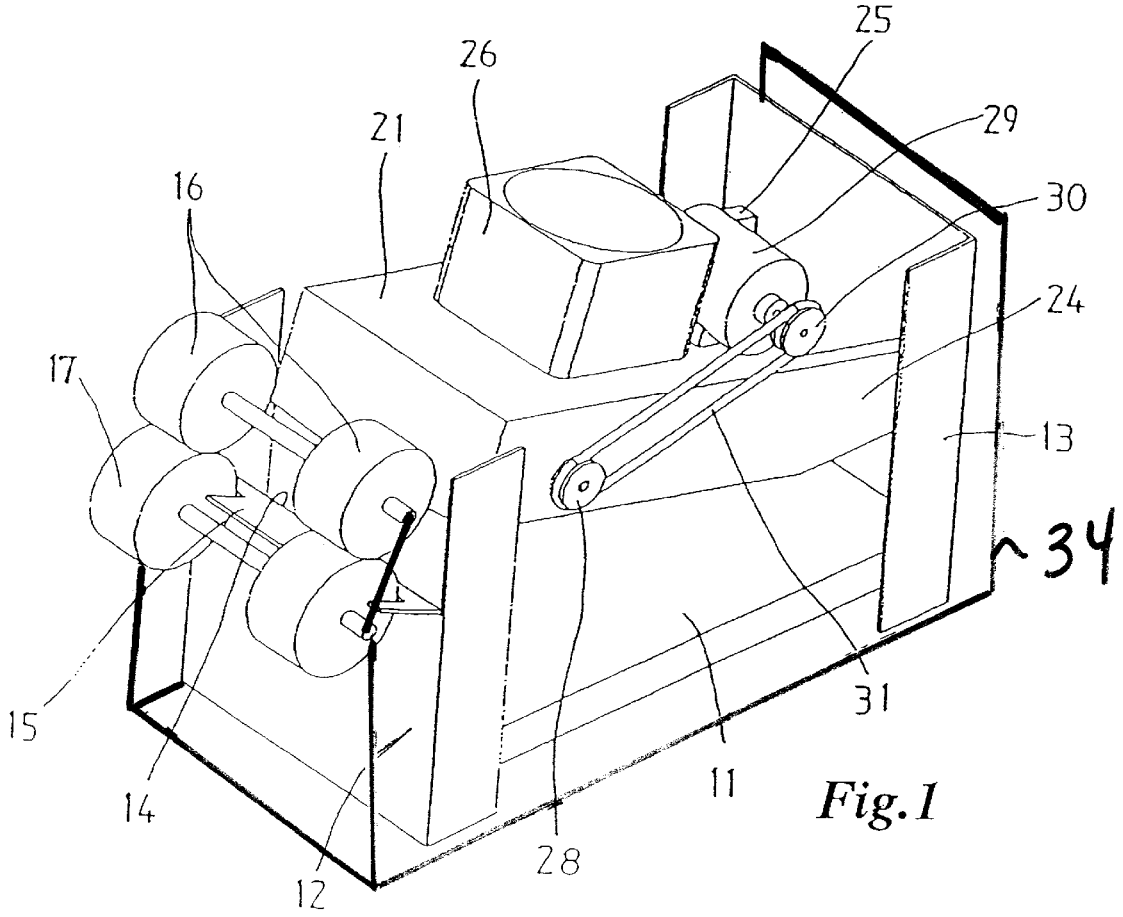
FIG. 1 is a perspective view which shows a portion of interest of the apparatus for paying out sheet bodies according to the invention.

Referring to the drawing and in particular to FIG. 1, the invention comprises a payout device for sheets. An elevator 11 is provided in the form of a big rectangular plate (see the lower portion of FIG. 1). Elevator 11 acts to pile the sheet bodies such as bills and to upwardly carry the layered sheet bodies.

The elevator 11 is equipped to rise when the weight is lightened. This is accomplished by means of a spring (not shown) and the like which is sensitive to the weight. Two standing guide frames 12, 13 surround each end part of the elevator 11. The standing guide frames 12, 13 are, for instance, plate bodies which are formed to be bent in the U-shaped form.

In the upper portion of guide frame 12 on the left or outlet side of the apparatus as shown in FIG. 1, an outlet 14 is formed to pay out a sheet body (not shown). At the lower edge of this outlet 14, a guide fragment 15 is provided.

Near the upper outside portion of the outlet 14 a gripper in the form of, two pairs of rubber rollers 16, 17 are disposed. These rubber rollers 16, 17 act to sandwich and draw out the sheet body. These rollers 16, 17 are preferably mounted on a case 34 of a box form which covers the whole apparatus and forms a drawer means.

Figure 2:
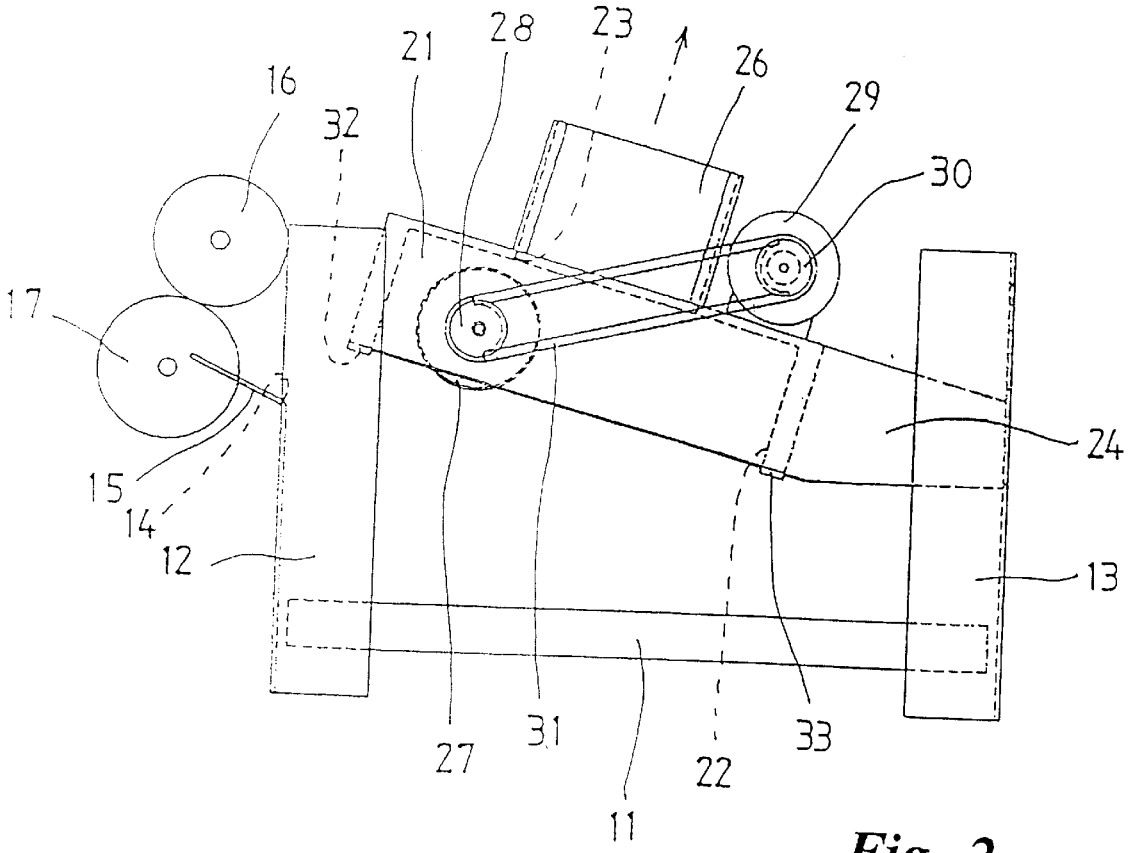
FIG. 2 is a front view of the device of FIG. 1.
Figure 3:
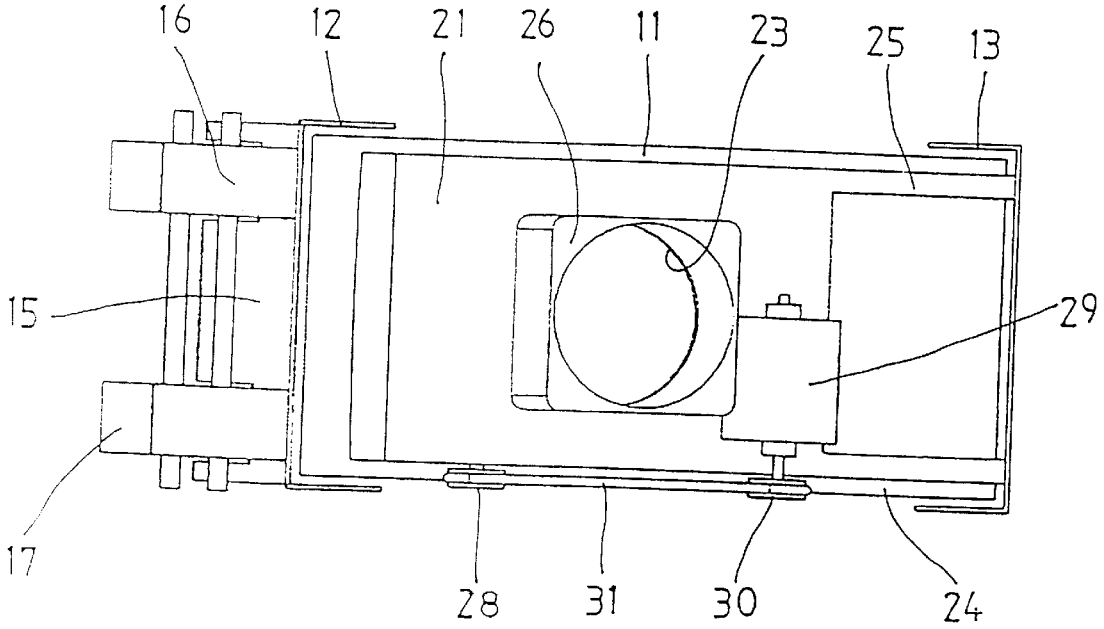
FIG. 3 is a plan view of the device of FIG. 1.
Figure 4A:
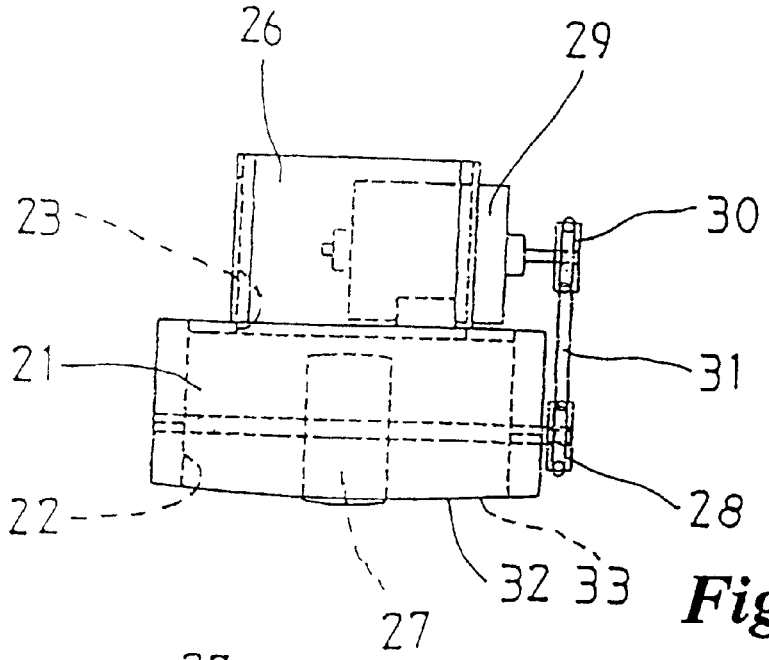
FIG. 4A is a side view of the device of FIG. 1.

A sheet body suction apparatus 21 is provided as a slightly big box form, shown at the center of FIG. 1. This suction apparatus 21, as shown in FIG. 2 and FIG. 4, is provided with a lower part or receiving side with an opening 22 and the upper part with a small opening 23.

The suction apparatus 21 is fixed on by welding or the like inside the guide frame 13. The guide frame 13 is intervened by one pair of protruded arms 24, 25. The suction apparatus 21 is, as shown in FIG. 2, formed at the slightly raised and diagonal posture against the elevator 11.

At the center on the suction apparatus 21, a small fan apparatus 26 is disposed. In the drawing, the fan apparatus 26 is illustrated schematically. When the fan apparatus 26 is driven, as shown at the arrow in FIG. 2, air flows to the small opening 23 from the big opening 22. As an alternative an insert tube (not shown) may be provided, inserted into the small opening 23 instead of the fan apparatus 26. Such an insert tube may be mounted in an airtight manner for providing suction.

In the big opening 22 of suction apparatus 21 at nearly the outlet 14, a small rubber wheel in the form of a small rubber tire 27 is rotatably disposed on an shaft. A pulley 28 is fixed at the out end of the rotating axis of tire 27. This tire 27 operates to send out a sheet body (not shown) which was absorbed or sucked up at the opening 22 of suction apparatus 21 to the direction of outlet 14 by the frictional power which occurs based on contact between the sheet body and the rubber wheel 27. A motor 29 is provided on the suction apparatus 21. The motor 29 is fixed to a pulley 30 which is provided on the shaft axis of the motor 29. A rubber belt 31, which acts as a transmission device, is expanded over the pulleys 28, 30 to provide a pulley pair.

Figure 5A:
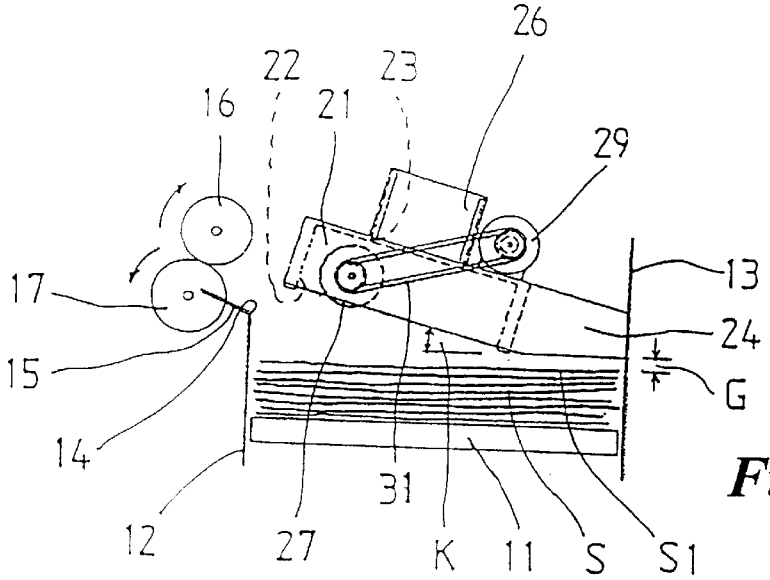
FIG. 5A is a side sectional schematic view showing an operation state of the device of the invention.

The operation of the embodiment which comprises the above-mentioned constitution, is described below firstly as with reference to the showing of FIG. 5A. A plurality of sheet bodies S are piled on the elevator 11 in a layered manner. When the sheet body S is a bill, a gap G between the first sheet body S1 on the sheet bodies S and the edge most below in the opening 22 is desirably about 5 mm. However, the size of gap G may be changed on the basis of the size, the thickness, the weight and the like such as sheet bodies S which are in the form of a card. Therefore, one is not limited to above-mentioned numerical value, of course.

Figure 5B:
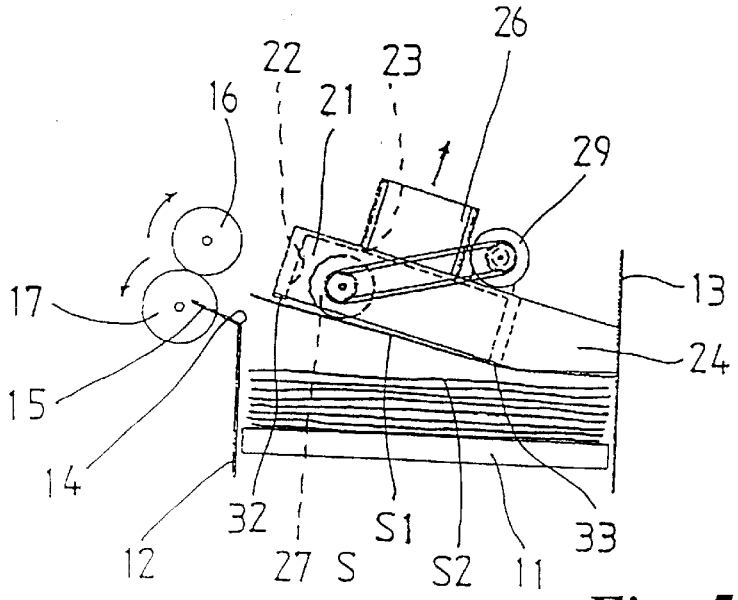
FIG. 5B is a schematic view similar to FIG. 5A, showing another operation state of the device of the invention.

Next, when the suction apparatus 26 is driven, as shown in FIG. 5B, the air is blown upwardly and the negative pressure occurs in the opening 22. The sheet body S1, the uppermost top sheet body S, is as a result absorbed or sucked up at the opening 22, as shown in FIG. 5B. In this case, the underside of the suction apparatus 21, i.e. the edge surface on the opening 22 has an angle K (referring to FIG. 5A) to the horizontal plane. Therefore, the sheet body S1 is, as shown in FIG. 5B, bent at a bend line located at ⅓ from the right or opposite side of the apparatus or the body S1.

As a result, in case of sheet bodies S being new bills, or in case of sheet bodies S being so-called new tickets, by this bend, the top new bill is totally separated from the new bill below. Therefore, there is the certainty that two-sheets (sheet bodies S) do not pass out. In case of cards it may not be possible to provide for such a bend or the like. The angle K is not necessary.

Figure 4B:
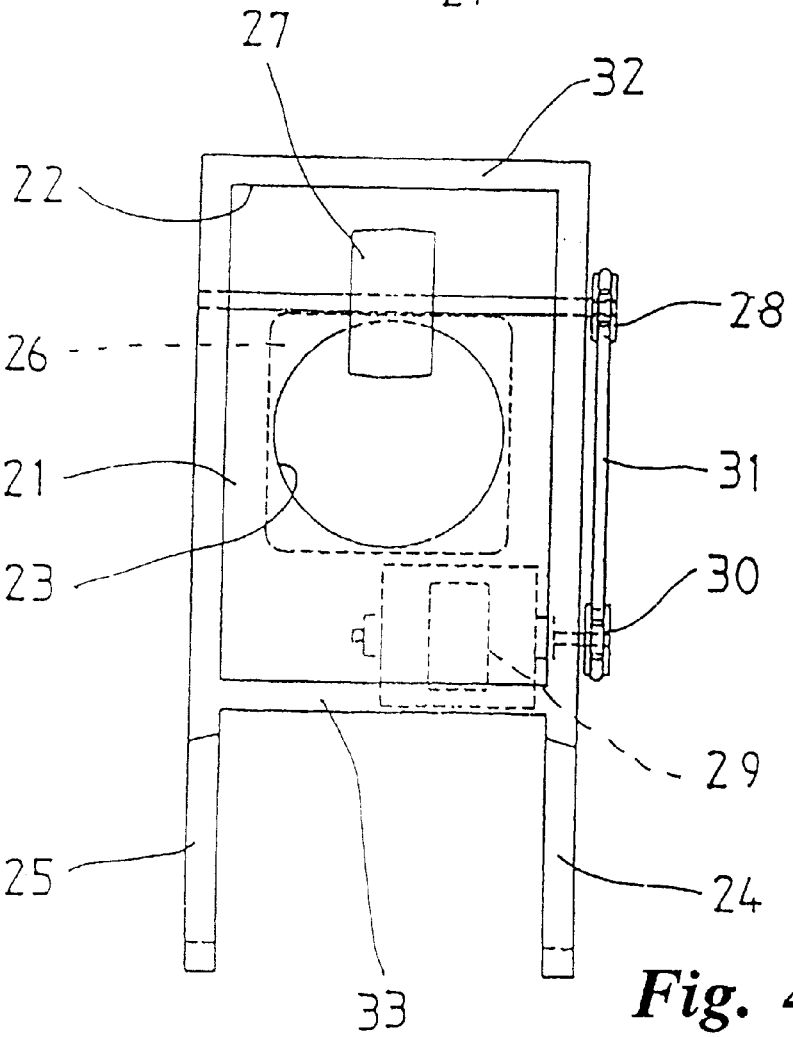
FIG. 4B is a bottom view of the device of FIG. 1.

Moreover, at the underside of the box-shaped suction apparatus 21, as seen in FIG. 2, the opening edges 32, 33 form a part of a receiving surface of the receiving side. As shown in FIG. 4B, the area of the opening 22 is larger than the area of the receiving surface. The receiving surfaces formed by edges 32, 33 on either side of the opening 22 are curved slightly and projectingly to the lower direction, as shown FIG. 4A. In the case of a bill in which a short portion is left with the sheet body S rounded or curled, the bill is curved to the direction of the width of the bill with the curve of opening edges 32, 33 when the bill is absorbed by the suction apparatus 21. Therefore, the curl in the length direction is removed and the bill becomes flat. However, the opening edges 32, 33 on either side may also be curved and depressed to the upper direction, contrary to FIG. 4A.

Also, in case of the sheet body S which doesn't have a curl and the like, the curves of the concave or convex opening edges 32, 33 are not necessary of course.

Next, in the condition shown in FIG. 5B, when the motor 29 is operated, the tire 27 is rotated through the pulley 30, the belt 31, the pulley 28. As the result, as shown in FIG. 5C, the sheet body S1 which is absorbed on the opening 22 is sent out to the direction of outlet 14 by the friction power of the tire 27.

When the about ¼ portion on the left side (viewing FIG. 5C) of sheet body S1 is sent out, the tip part of this sheet body S1 is sandwiched between rollers 16 and 17 which are paired. As soon as this is sandwiched. it is quickly dragged by the rollers 16, 17 which turn faster than the tire 27 and, as shown in FIG. 5D, it begins to be paid out to the outside direction.

Figure 5C:
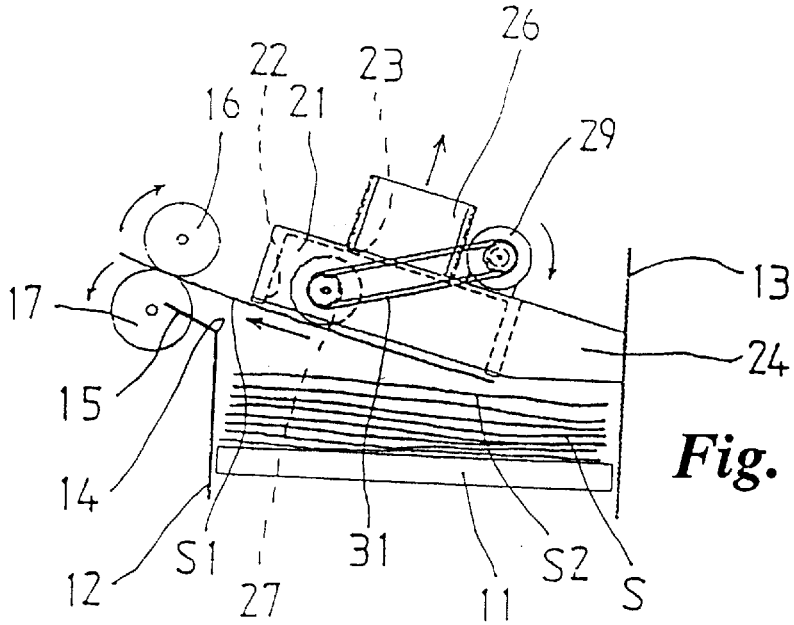
FIG. 5C is a schematic view similar to FIG. 5A, showing another operation state of the device of the invention.
Figure 5D:
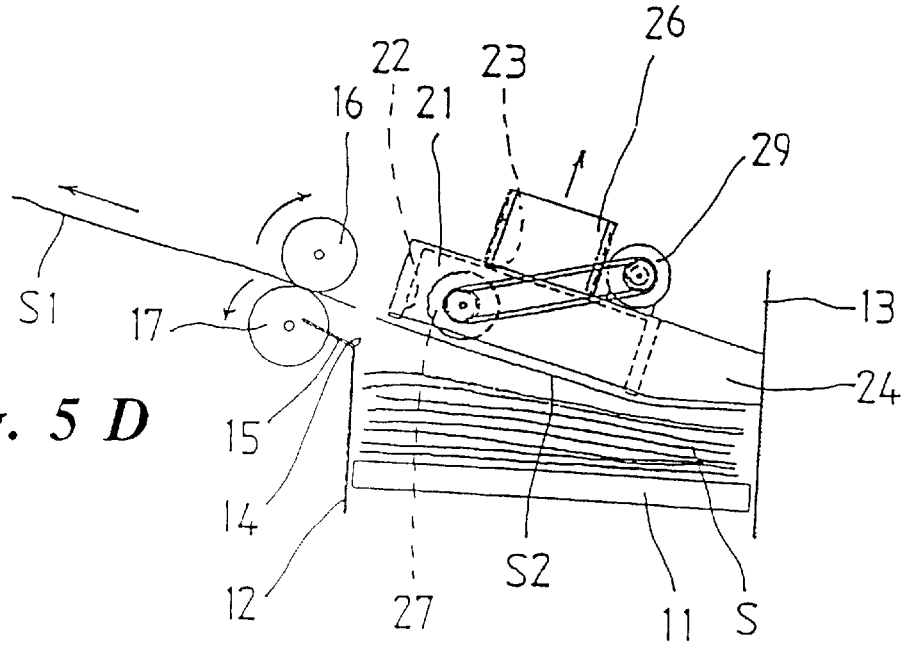
FIG. 5D is a schematic view similar to FIG. 5A, showing another operation state of the device of the invention.

When moving from the condition of FIG. 5C to the condition of FIG. 5D, the tip part of the first sheet body S1 is put between a pair of rollers 16 and 17, and an approximately ⅔ portion on the left side of sheet body S1 is sent out from the suction apparatus 21. At this time, the illustration is omitted and, the about a right half portion of opening 22 (in FIG. 5D) is released, and the center of the following second sheet body S2 is sucked and rises up.

Moreover, when the whole opening 22 is released, the following sheet body S2 is, as shown in FIG. 5D, absorbed at the opening 22 of the suction apparatus 21. Further, in the operation description at the above mentioned FIGS. 5A–5D, the suction apparatus 21 is continuously driven and the tire 27 is rotated as needed. However, continuous rotation of the tire 27 is also possible and the calculation of the number of sheet bodies S to pay out is made with another apparatus (not shown).

The invention allows a payout of sheet bodies S surely and with certainty and moreover at higher speed than prior devices. Also, according to the invention and the disclosed preferred embodiment, the tire (or wheel) is disposed within the opening 22 of the suction apparatus. However, depending on the size, the hardness and the like of sheet body S, the opening 22 is made small and the tire 27 may be disposed outside of opening 22. In this case, the tire 27 touches a part of the sheet body S which is outside the suction apparatus 21 or a part of the card body and, the sheet or card body is sent out by the frictional power.

Also, in the description so far, a sending out apparatus of which the elevator 11 is arranged below is illustrated. However, being based on the size, the thickness of the sheet or the card body and the like, the apparatus of which the elevator 11 is arranged diagonally or perpendicularly or above is permitted of course. In other words, depending on the size, the thickness of the sheet or the card body and the like, even if the sending out apparatus illustrated is mounted on a setting up condition or on a upside down condition or on a tumble condition, a similar operation is gotten of course.

According to this present invention above mentioned, by the combination with simple constitution, a desirable effect is achieved that a sheet body payout apparatus is provided with a small and simple structure. That is, by combining a suction means of the fan and the like and a sending out means of the tire and the like according to this present invention, a sheet body payout apparatus with the small and simple structure is attained.

In addition, according to this present invention, a big advantage is also attained that sheet bodies one by one can be sent surely and at high speed.

While a specific embodiment of the invention has been shown and described in detail to illustrate the application of the principles of the invention, it will be understood that the invention may be embodied otherwise without departing from such principles.

What is claimed is:

1. An apparatus for paying out a sheet body of a defined size from a stack of sheet bodies, the apparatus comprising:

a suction body having a receiving side for receiving the sheet body after the sheet body has been sucked up, said receiving side defining an opening for entrance of air and said suction body including a receiving surface extending in a longitudnal direction and in a transverse direction to form a perimeter around said opening, said receiving surface contacting said sheet body having a suction side edge defining an opening for absorbing the sheet body to said receiving side, said suction body having an exhaust opening for exhausting air, said opening having longitudinal side edges equal to a fraction of the longitudinal length of the sheet body;

a fan assembly including a fan and a fan housing with a suction low pressure suction side having an suction side opening and with a high pressure exhaust side having an exhaust opening, said fan assembly being mounted on said suction body, said fan housing being directly connected to said suction body with said fan assembly suction side opening directly communicating with said exhaust opening for forming a suction zone in said suction body for sucking air through said opening to suck the sheet body to said receiving side; and a sheet body issuing device positioned with a contact surface within said suction body opening periphery and positioned in said suction zone including a movable engagement surface for moving the sheet body which is sucked up on said receiving side away from said suction body, said contact surface moving the sheet body in a longitudinal direction, said suction body receiving side having transversely extending portions which curve about an axis substantially parallel to said longitudinal direction.

2. The apparatus according to claim 1, wherein said sheet body issuing device is a small tire disposed within said opening of said suction body and said sheet body issuing device further includes a motor mounted on said suction body and connects to said small tire via a transmission device.

3. The apparatus according to claim 2, further comprising a drawing device for drawing out the sheet body sent out by said small tire.

4. The apparatus according to claim 3, wherein said drawing device includes a plurality of rollers.

5. An apparatus in accordance with claim 1, wherein:

said suction body receiving side has a bend with a bend line substantially parallel to said transverse direction.

6. An apparatus hi accordance with claim 1, further comprising:

an elevator positioned on a side of the sheet body opposite said suction body, said elevator holding a plurality of the sheet bodies and raising the sheet bodies, said receiving surface of said suction body having a main part angularly spaced from a plane of the sheet bodies held in said elevator and having an extension part substantially parallel to a plane of the sheet bodies held in said elevator with a bend line, substantially parallel to said transverse direction, separating said main part from said extension part, said main part surrounding said opening.

7. An apparatus for discharging a sheet body comprising:

suction body having a receiving side with a receiving surface for receiving the sheet body with an opening with an opening periphery with longitudinal side edges and a transverse side edge;

a sheet body issuing device positioned within said suction body opening periphery and including a friction surface for moving the sheet body which is sucked up on said suction body away from said suction body, said friction surface projecting from said opening, said friction surface moving the sheet body in a longitudinal direction; and an elevator positioned on a side of the sheet body opposite said suction body, said elevator holding a plurality of the sheet bodies for raising the plurality of sheet bodies, said elevator having an outlet side and an opposite side, said suction body being positioned with said opening adjacent to said outlet side and covering a fraction of a longitudinal extent of said sheet bodies between said outlet side and said opposite side, said receiving surface of said suction body having a main part angularly spaced from a plane of the sheet bodies held in said elevator and having an extension part substantially parallel to a plane of the sheet bodies held in said elevator with a bend line, substantially parallel to said transverse direction, separating said main part from said extension part, said main part surrounding said opening.

8. An apparatus in accordance with claim 7, wherein:

said suction body receiving side has a bend with a bend line substantially parallel to said transverse direction.

9. An apparatus in accordance with claim 7, wherein:

said suction body receiving side has transversely extending portions which curve about an axis substantially parallel to said longitudinal direction.

10. An apparatus in accordance with claim 7, wherein:

said bend line is positioned at location that is a fraction of a length of the sheet body from said opposite side;

said suction opening is positioned between said bend line and said outlet side; and a gripper is arranged spaced from said outlet side and diametrically opposite said suction body, said gripper being spaced to grip the sheet body when a fraction of the length of the sheet body has been sent out by said sheet body issuing device.

11. An apparatus in accordance with claim 7, further comprising:

a fan assembly including a fan and a fan housing with a suction low pressure suction side having an suction side opening and with a high pressure exhaust side having an exhaust opening, said fan assembly being mounted on said suction body, said fan housing being directly connected to said suction body with said fan assembly suction side opening directly communicating with said exhaust opening for forming a suction zone in said suction body for sucking air through said opening to suck a sheet body to said receiving side.

12. An apparatus for paying out a sheet body of a defined size from a stack of sheet bodies, the apparatus comprising:

a suction body having a receiving side for receiving the sheet body after the sheet body has been sucked up, said receiving side defining an opening for entrance of air and said suction body including a receiving surface extending in a longitudnal direction and in a transverse direction to form a perimeter around said opening, said receiving surface contacting said sheet body having a suction side edge defining an opening for absorbing the sheet body to said receiving side, said suction body having an exhaust opening for exhausting air, said opening having longitudinal side edges equal to a fraction of the longitudinal length of the sheet body;

a fan assembly including a fan and a fan housing with a suction low pressure suction side having an suction side opening and with a high pressure exhaust side having an exhaust opening, said fan assembly being mounted on said suction body, said fan housing being directly connected to said suction body with said fan assembly suction side opening directly communicating with said exhaust opening for forming a suction zone in said suction body for sucking air through said opening to suck the sheet body to said receiving side;

a sheet body issuing device positioned with a contact surface within said suction body opening periphery and positioned in said suction zone including a movable engagement surface for moving the sheet body which is sucked up on said receiving side away from said suction body, said contact surface moving the sheet body in a longitudinal direction; and an elevator positioned on a side of the sheet body opposite said suction body, said elevator holding a plurality of the sheet bodies and raising the sheet bodies, said receiving surface of said suction body having a main part angularly spaced from a plane of the sheet bodies held in said elevator and having an extension part substantially parallel to a plane of the sheet bodies held in said elevator with a bend line, substantially parallel to said transverse direction, separating said main part from said extension part, said main part surrounding said opening.

* * * * *

UNITED STATES PATENT AND TRADEMARK OFFICE

CERTIFICATE OF CORRECTION

PATENT NO. : 6,315,281 B1
DATED : November 13, 2001
INVENTOR(S) : Ehara et al.

It is certified that error appears in the above-identified patent and that said Letters Patent is hereby corrected as shown below:

Column 5,
Line 30, each occurance of “longitudnal” should read -- longitudinal --.

Column 6,
Line 19, please add -- a -- before “suction”.

Column 7,
Line 15, each occurance of “longitudnal” should read -- longitudinal --.

Signed and Sealed this

Twenty-fourth Day of May, 2005

JON W. DUDAS
*Director of the United States Patent and Trademark Office*